US009810457B2

(12) United States Patent
Park et al.

(10) Patent No.: US 9,810,457 B2
(45) Date of Patent: Nov. 7, 2017

(54) AIR CONDITIONER

(71) Applicant: LG Electronics Inc., Seoul (KR)

(72) Inventors: Heewoong Park, Changwon-si (KR); Noma Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 199 days.

(21) Appl. No.: 14/585,881

(22) Filed: Dec. 30, 2014

(65) Prior Publication Data

US 2015/0184905 A1 Jul. 2, 2015

(30) Foreign Application Priority Data

Dec. 31, 2013 (KR) ..... 10-2013-0168799

(51) Int. Cl.

| | |
|---|---|
| ***F25B 30/02*** | (2006.01) |
| ***F25B 41/00*** | (2006.01) |
| ***F25B 13/00*** | (2006.01) |
| ***F25B 40/00*** | (2006.01) |
| ***F25B 43/00*** | (2006.01) |

(52) U.S. Cl.

CPC ..... *F25B 30/02* (2013.01); *F25B 13/00* (2013.01); *F25B 40/00* (2013.01); *F25B 41/00* (2013.01); *F25B 43/006* (2013.01); *F25B 2400/051* (2013.01); *F25B 2400/13* (2013.01); *F25B 2400/23* (2013.01); *F25B 2400/24* (2013.01)

(58) Field of Classification Search

CPC ..... F25B 30/02; F25B 41/00; F25B 13/00; F25B 40/00; F25B 43/006; F25B 2400/24; F25B 2400/051; F25B 2400/13; F25B 2400/23; F25B 1/10; F25B 49/027; F25B 2341/0653; F25B 2600/21; F25B 2600/2509

USPC ..... 62/324.1, 503

See application file for complete search history.

(56) References Cited

U.S. PATENT DOCUMENTS 3,651,657 A * 3/1972 Bottum ..... F25B 43/006 62/196.3
3,766,748 A * 10/1973 Bottum ..... B60H 1/3204 62/243
4,236,381 A * 12/1980 Imral ..... F25B 13/00 62/324.1

(Continued)

FOREIGN PATENT DOCUMENTS

JP H 8-5185 1/1996

OTHER PUBLICATIONS

European Search Report issued in Application No. 14190205.6 dated Apr. 30, 2015.

*Primary Examiner* — Mohammad M Ali
(74) *Attorney, Agent, or Firm* — Ked & Associates LLP

(57) ABSTRACT

An air conditioner is provided. The air conditioner may include a compressor, an outdoor heat-exchanger, an indoor heat-exchanger, a converter valve, an accumulator, an accumulator jacket, and a supercooling heat-exchange hub. The accumulator jacket may be disposed on a surface of the accumulator and contain a refrigerating fluid flowing therein. The refrigerating fluid may exchange heat with the accumulator to be cooled. The supercooling heat-exchange hub may be connected to the accumulator jacket to store the cooled refrigerating fluid and overcool the refrigerant flowing between the outdoor heat-exchanger and the indoor heat-exchanger.

7 Claims, 9 Drawing Sheets

(56) References Cited

U.S. PATENT DOCUMENTS

| | | | | |
|---|---|---|---|---|
| 4,507,936 | A * | 4/1985 | Yoshino | F24D 11/0221 126/573 |
| 6,463,757 | B1 * | 10/2002 | Dickson | F25B 40/00 29/890.06 |
| 2004/0003624 | A1 * | 1/2004 | Kadle | B60H 1/00485 62/513 |
| 2010/0205988 | A1 * | 8/2010 | Jiang | F25B 1/10 62/225 |
| 2010/0218513 | A1 * | 9/2010 | Vaisman | F01K 7/32 62/6 |
| 2013/0213087 | A1 * | 8/2013 | Currence | F25J 3/0209 62/621 |

* cited by examiner

AIR CONDITIONER

CROSS-REFERENCE TO RELATED APPLICATION(S)

This application claims priority under 35 U.S.C. §119 to Korean Application No. 10-2013-0168799, filed in Korea on Dec. 31, 2013, whose entire disclosure is hereby incorporated by reference.

BACKGROUND

1. Field

An air conditioner is disclosed herein.

2. Background

Generally, an air conditioner is an apparatus that keeps indoor air cool or warm using a refrigeration cycle including a compressor, an outdoor heat-exchanger, an expansion valve, and an indoor heat-exchanger. That is, the air conditioner may include a cooling device to cool indoor air cool and a heating device to heat indoor air. The air conditioner may be designed to perform both cooling and heating functions.

When the air conditioner is designed to perform both the cooling and heating functions, the air conditioner may include a four-way valve to convert a flow passage of a refrigerant compressed by a compressor in accordance with operational conditions, that is, a cooling operation and a heating operation. During the cooling operation, the refrigerant compressed in the compressor may flow to the outdoor heat-exchanger through the four-way valve, and the outdoor heat-exchanger may function as a condenser. The refrigerant condensed by the outdoor heat-exchanger may expand in the expansion valve, and then, flow into the indoor heat-exchanger. In this case, the indoor heat-exchanger may function as a vaporizer. The refrigerant vaporized by the indoor heat-exchanger may be redirected into the compressor through the four-way valve.

During the cooling operation of this air conditioner, when the refrigerant flowing into the indoor heat-exchanger is supercooled, efficiency is improved.

BRIEF DESCRIPTION OF THE DRAWINGS

Embodiments will be described in detail with reference to the following drawings in which like reference numerals refer to like elements, and wherein.

DETAILED DESCRIPTION

Figure 1:
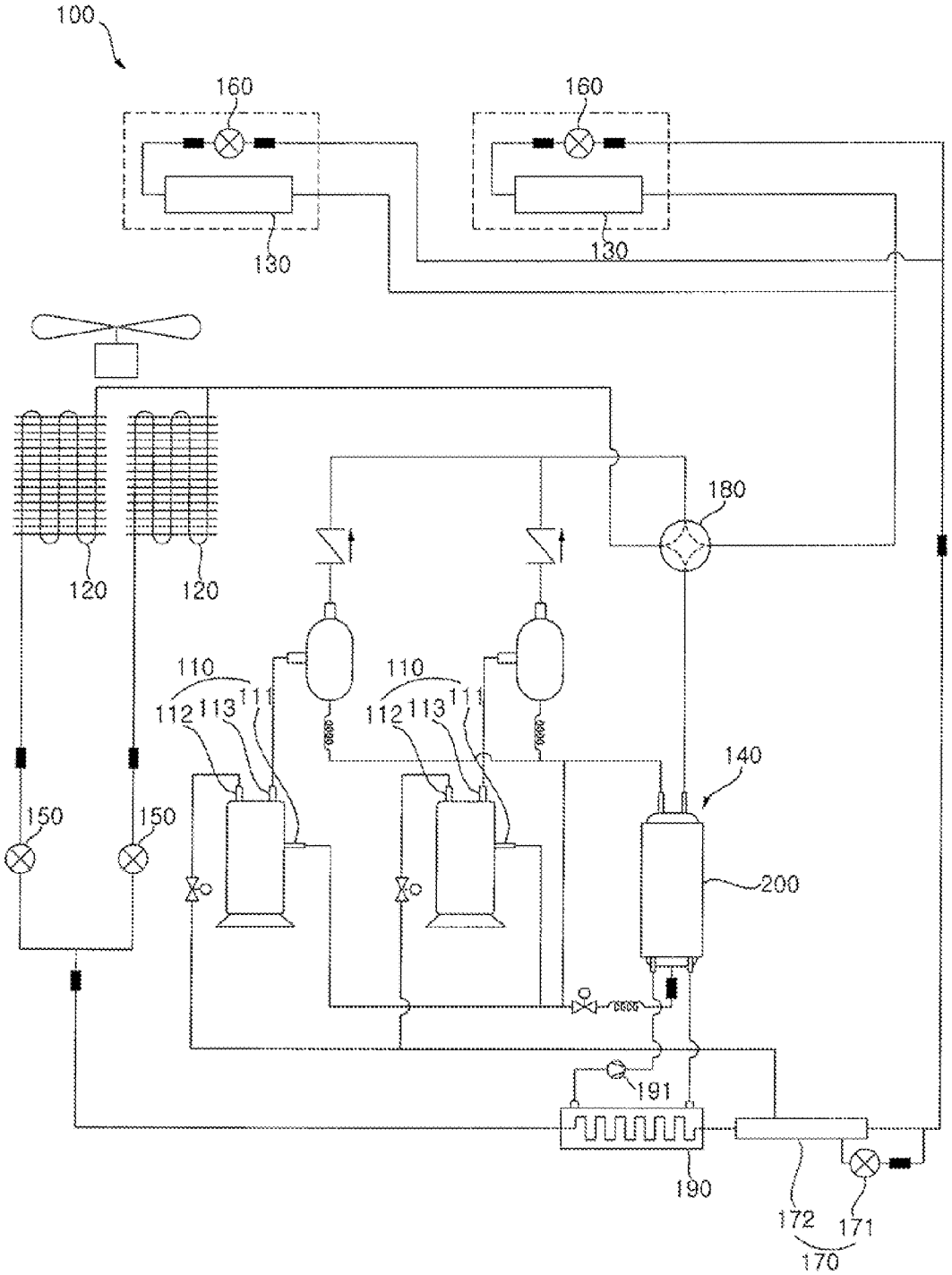
FIG. 1 is a schematic diagram of a refrigerant cycle circuit of an air conditioner according to an embodiment.

The foregoing and other objects, features, aspects and advantages will become more apparent from the following detailed description when taken in conjunction with the accompanying drawings. Exemplary embodiments will now be described in detail with reference to the accompanying drawings. The embodiments may, however, be embodied in many different forms and should not be construed as being limited to the embodiments set forth herein. Rather, these embodiments are provided so that this disclosure will be thorough and complete, and will fully convey the scope to those skilled in the art. In the drawings, the shapes and dimensions may be exaggerated for clarity, and the same reference numerals will be used throughout to designate the same or like components.

Hereinafter, embodiments of an air conditioner will be described in detail with reference to the accompanying drawings. Where possible, like reference numerals have been used to indicate like elements and repetitive disclosure has been omitted.

Figure 2:
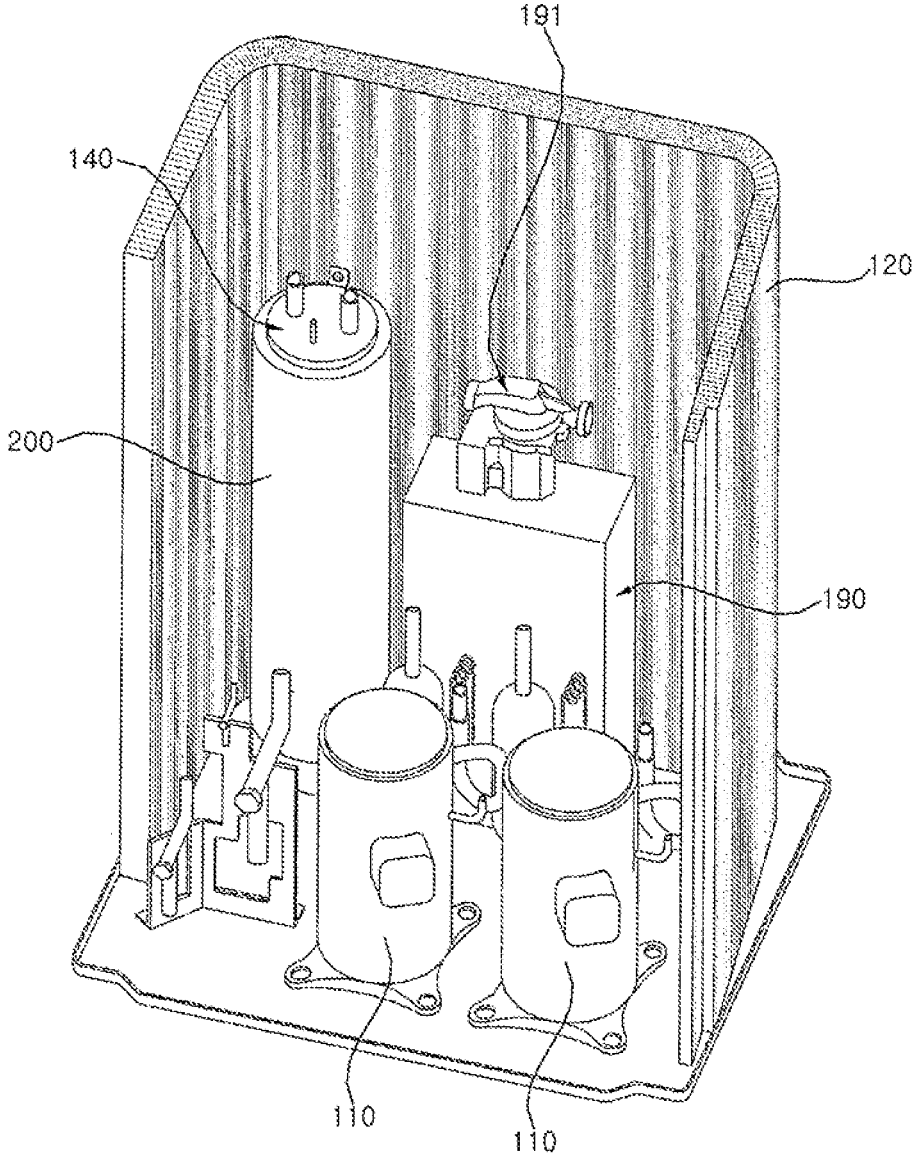
FIG. 2 is a view illustrating a portion of an outdoor device of an air conditioner according to an embodiment.
Figure 3:
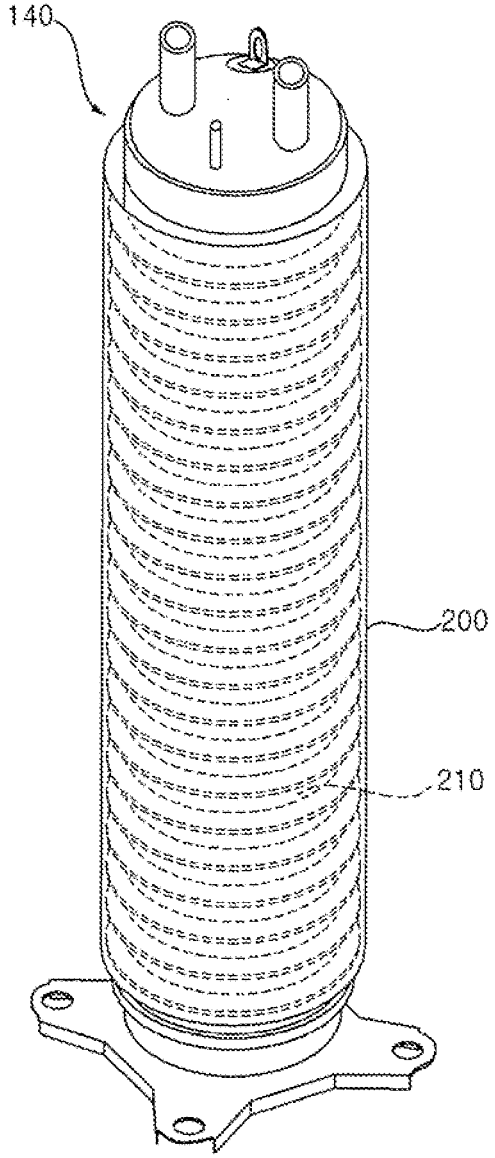
FIG. 3 is a view illustrating an accumulator jacket installed on an accumulator of an air conditioner according to an embodiment.

FIG. 1 is a schematic diagram of a refrigerant cycle circuit of an air conditioner according to an embodiment. FIG. 2 is a view illustrating a portion of an outdoor device of an air conditioner according to an embodiment. FIG. 3 is a view illustrating an accumulator jacket installed on an accumulator of an air conditioner according to an embodiment.

Referring to FIGS. 1 to 3, an air conditioner 100 according to an embodiment may include one or more compressor 110 that compresses a refrigerant, one or more outdoor heat-exchanger 120 disposed outside of a room to heat-exchange between outdoor air and the refrigerant, one or more indoor heat-exchanger 130 disposed inside of the room to heat-exchange between indoor air and the refrigerant, a converter valve 180 that guides the refrigerant discharged from the compressor 110 to the outdoor heat-exchanger 120 during a cooling operation and guides the refrigerant to the indoor heat-exchanger 130 during a heating operation, an accumulator 140 disposed between the compressor 110 and the converter valve 180 to separate the refrigerant into a liquid-phase refrigerant and a gas-phase refrigerant, an accumulator jacket 200 disposed on a surface of the accumulator 140 and containing a refrigerating fluid that absorbs cold and heat generated in the accumulator 140, a supercooling heat-exchange hub 190 connected to the accumulator jacket 200 to store the refrigerating fluid that absorbs the cold and heat of the accumulator 140 and disposed between the outdoor heat-exchanger 120 and the indoor heat-exchanger 130 to supercool the refrigerant, a circulating pump 191 that circulates the refrigerating fluid flowing in the supercooling heat-exchange hub 190 and the accumulator jacket 200, and an injection module 170 disposed between the outdoor heat-exchanger 120 and the indoor heat-exchanger 130 that injects a portion of the refrigerant flowing between the outdoor heat-exchanger 120 and the indoor heat-exchanger 130 to the compressor 110. Piping may connect or provide fluid communication between the various components of the air conditioner 100, and through which the refrigerant may flow.

The air conditioner 100 may include an outdoor device disposed outside of a room and one or more indoor device disposed inside of the room, and the outdoor device and the indoor device may be connected to each other, or in fluid communication via the piping. The outdoor device may include the one or more compressor 110, the one or more outdoor heat-exchanger 120, the one or more outdoor expansion valve 150, the injection module 170, the accumulator 140, the supercooling heat-exchange hub 190, the circulating pump 191, and the accumulator jacket 200. Each indoor device may include the indoor heat-exchanger 130 and an indoor expansion valve 160.

The compressor 110 may disposed in the outdoor device, and may compress a refrigerant introduced at a low-pressure and low-temperature state to a refrigerant of a high-pressure and high-temperature state. The compressor 110 may be formed in a variety of structures. That is, the compressor 110 may be a reciprocating compressor using a cylinder and a piston, a scroll compressor using an orbiting scroll and a fixed scroll, or an inverter compressor that controls a compression amount of refrigerant according to an operation frequency.

A plurality of compressor 110 may be provided according to embodiments. In this embodiment, two compressors are provided.

The compressor 110 may be connected to, or in fluid communication via the piping the converter valve 180, the accumulator 140, and the injection module 170. The compressor 110 may include an inlet port 111 through which a refrigerant vaporized in the indoor heat-exchanger 130 during the cooling operation may be introduced or a refrigerant vaporized in the outdoor heat-exchanger 120 during the heating operation may be introduced, an injection port 112, through which a relatively low-pressure refrigerant heat-exchanged to be vaporized in the injection module 170 may be injected, and an outlet port 113, through which a compressed refrigerant may be discharged. That is, the compressor 110 may include the inlet port 111, through which the refrigerant vaporized in the outdoor and indoor heat exchangers 120 and 130 may be introduced, the injection port 112, through which the relatively low-pressure refrigerant heat-exchanged to be vaporized in the injection module 170 may be injected, and the outlet port 113, through which the compressed refrigerant may pass through the converting valve 180 to be discharged to the outdoor and indoor heat exchangers 120 and 130.

The compressor 110 may compress the refrigerant, which may be introduced through the inlet port 111 into a compressing chamber, and may mix the refrigerant introduced through the injection port 112 to be compressed together during the compression of the refrigerant introduced through the inlet port 111. The compressor 110 may compress the mixed refrigerant, and then may discharge the compressed refrigerant through the outlet port 113. The refrigerant discharged from the outlet port 113 may flow to the converter valve 180.

The converter valve 180 may be a flow passage converter valve for cooling-heating conversion. The converter valve 180 may guide the refrigerant compressed in the compressor 110 to the outdoor heat-exchanger 120 during the cooling operation and to the indoor heat exchanger 130 during the heating operation.

The converter valve 180 may be connected to, or in fluid communication via the piping the outlet port 113 of the compressor 110 and the accumulator 140, and the indoor and outdoor heat-exchangers 130 and 120. During the cooling operation, the converter valve 180 may connect the outlet port 113 of the compressor 110 to the outdoor heat-exchanger 120, and may connect the indoor heat-exchanger 130 to the accumulator 140 or connect the indoor heat-exchanger 130 to the inlet port 111 of the compressor 110. During the heating operation, the converter valve 180 may connect the outlet port 113 of the compressor 110 to the indoor heat-exchanger 130, and may connect the outdoor heat-exchanger 120 to the accumulator 140 or connect the outdoor heat-exchanger 120 to the inlet port 111 of the compressor 110.

The converter valve 180 may be formed in a variety of different modules that may connect different flow passages to each other. In this embodiment, a four-way valve may be used. However, embodiments are not limited to this embodiment. A combination of two 3-way valves or other valves may be used as the converter valve 180.

The outdoor heat-exchanger 120 may be disposed in the outdoor device outside of a room, and may heat-exchange the refrigerant passing through the outdoor heat-exchanger 120 with the outdoor air. The outdoor heat-exchanger 120 may serve as a condenser to condense the refrigerant during the cooling operation, and may serve as an evaporator to vaporize the refrigerant during the heating operation.

The outdoor heat exchanger 120 may be connected to, or in fluid communication via the piping the converter valve 180 and the outdoor expansion valve 150. During the cooling operation, the refrigerant compressed in the compressor 110 and passing through the outlet port 113 of the compressor 110 and the converter valve 180 may be introduced into the outdoor heat-exchanger 120, and then, may be condensed to flow to the outdoor expansion valve 150. During the heating operation, the refrigerant expanding in the outdoor expansion valve 150 may flow into the outdoor heat-exchanger 120, and then, may be vaporized to flow to the converter valve 180.

The outdoor expansion valve 150 may be completely opened during the cooling operation to allow the refrigerant to pass therethrough. During the heating operation, the opening degree of the indoor expansion valve 150 may be controlled to expand the refrigerant. The outdoor expansion valve 150 may be disposed between the outdoor heat-exchanger 120 and the supercooling heat-exchange hub 190. However, in one embodiment, the outdoor expansion valve 150 may be disposed between the outdoor heat-exchanger 120 and an injection heat-exchanger 172.

The outdoor expansion valve 150 may pass and guide the refrigerant introduced from the outdoor heat exchanger 120 to the supercooling heat-exchange hub 190 during the cooling operation. The outdoor expansion valve 150 may expand and guide the refrigerant heat-exchanged in the injection module 170 and passing through the supercooling heat-exchange hub 190 to the outdoor heat exchanger 120 during the heating operation.

The indoor heat-exchanger 130 may be disposed in the indoor device inside of a room, and may heat-exchange the refrigerant passing through the indoor heat-exchanger 130 with the indoor air. During the cooling operation, the indoor heat-exchanger 130 may serve as a vaporizer to vaporize the refrigerant. During the heating operation, the indoor heat-exchanger 130 may serve as a condenser to condense the refrigerant.

The indoor heat exchanger 130 may be connected to, or in fluid communication via the piping the converter valve 180 and the indoor expansion valve 160. During the cooling operation, the refrigerant expanded in the indoor expansion valve 160 may flow into the indoor heat-exchanger 130, and then, may be vaporized to flow to the converter valve 180. During the heating operation, the refrigerant compressed in the compressor 110 and passing through the outlet port 113 of the compressor 110 and the converter valve 180 may be introduced into the indoor heat-exchanger 130, and then, may be condensed to flow to the indoor expansion valve 160.

During the cooling operation, the opening degree of the indoor expansion valve 160 may be controlled to expand the refrigerant. During the heating operation, the indoor expansion valve 160 may be completely opened to allow the refrigerant to pass therethrough. The indoor expansion valve 160 may be disposed between the indoor heat-exchanger 130 and the injection module 170. However, in one embodiment, the indoor expansion valve 160 may be disposed between the indoor heat-exchanger 130 and the supercooling heat-exchange hub 190.

During the cooling operation, the refrigerant supplied to the indoor expansion valve 160 may be supercooled in the supercooling heat-exchange hub 190 and then expanded before flowing to the indoor heat-exchanger 130. During the heating operation, the indoor expansion valve 160 may pass and guide the refrigerant introduced from the indoor heat-exchanger 130 to the injection module 170.

The injection module 170 may be disposed between the indoor heat-exchanger 130 and the outdoor heat-exchanger 120, and may inject a portion of the refrigerant flowing between the indoor heat-exchanger 130 and the outdoor heat-exchanger 120 to the compressor 110. The injection module 170 may be connected to, or in fluid communication via the piping the supercooling heat-exchange hub 190 and the indoor expansion valve 160. In one embodiment, the injection module 170 may be disposed between the supercooling heat-exchange hub 190 and the outdoor expansion valve 150.

The injection module 170 may include an injection expansion valve 171 that expands a first portion of the refrigerant flowing between the indoor heat-exchanger 130 and the outdoor heat-exchanger 120, and the injection heat-exchanger 172 that heat-exchanges the other or a second portion of the refrigerant flowing between the indoor heat-exchanger 130 and the outdoor heat-exchanger 120 with the refrigerant being expanded in the injection expansion valve 171. The refrigerating fluid described hereinbelow may be a medium that exchanges heat with the accumulator 140 by circulating along the surface of the accumulator 140 through the accumulator jacket 200. The refrigerating fluid may be cooled by exchanging heat with the accumulator 140, and may be stored in the supercooling heat-exchange hub 190. Examples of refrigerating fluid may be a brine that includes organic media and inorganic media, such as NaCl, CaCl2, and MgCl2.

During the cooling operation, the refrigerant flowing from the outdoor heat-exchanger 120 to the indoor heat exchanger 130 may exchange heat with the refrigerating fluid in the supercooling heat-exchange hub 190 to be supercooled. Accordingly, during the cooling operation, as the injection expansion valve 171 is closed, the injection module 170 may be supercooled by the refrigerant having passed through the supercooling heat-exchange hub 190, and the refrigerant flowing to the indoor heat-exchanger 130 may not be heat exchanged in the injection heat-exchanger 172. That is, during the cooling operation, the injection module 170 may not heat-exchange the refrigerant flowing from the outdoor heat-exchanger 120 to the indoor heat-exchanger 130.

During the heating operation, the injection module 170 may exchange heat between a first portion of the refrigerant flowing from the indoor heat-exchanger 130 to the outdoor heat-exchanger 120 with the other or a second portion of the refrigerant flowing to the outdoor heat-exchanger 120, and then, may guide the refrigerant to the injection port 112 of the compressor 110.

Accordingly, during the cooling operation, a portion of the refrigerant may not be injected to the compressor 110, and during the heating operation, a portion of the refrigerant may be injected to the compressor 110. Hereinafter, the injection expansion valve 171 and the injection heat-exchanger 172 will be described based on the heating operation.

The injection expansion valve 171 may be connected to, or in fluid communication via the piping the indoor expansion valve 160, the injection heat-exchanger 172, and the supercooling heat-exchange hub 190. During the heating operation, the injection expansion valve 171 may expand a first portion of the refrigerant discharged out of the indoor heat exchanger 130 and having passed through the indoor expansion valve 160 to guide the first portion of the refrigerant to the injection heat-exchanger 172.

The injection heat-exchanger 172 may be connected to, in fluid communication via the piping the injection expansion valve 171, the supercooling heat-exchange hub 190, the compressor 110, and the indoor expansion valve 160. During the heating operation, the injection heat-exchanger 172 may exchange heat with the refrigerant expanded in the injection expansion valve 171 and the refrigerant flowing from the indoor heat-exchanger 130 to the outdoor heat-exchanger 120. The injection heat-exchanger 172 may guide the heat-exchanged refrigerant to the compressor 110. That is, the refrigerant heat-exchanged in the injection heat-exchanger 172 may be vaporized and introduced into the injection port 112 of the compressor 110.

The accumulator 140 may be disposed between the converter valve 180 and the inlet port 111 of the compressor 110. The accumulator 140 may be connected to, or in fluid communication via the piping the converter valve 180 and the inlet port 111 of the compressor 110. The accumulator 140 may separate a gas-phase refrigerant and a liquid-phase refrigerant from the refrigerant vaporized in the indoor heat-exchanger 130 during the cooling operation or the refrigerant vaporized in the outdoor heat-exchanger 120 during the heating operation, and may guide the gas-phase refrigerant to the inlet port 111 of the compressor 110. That is, the accumulator 140 may separate the gas-phase refrigerant and the liquid-phase refrigerant from the refrigerant vaporized in the outdoor and indoor heat exchangers 120 and 130 to guide the gas-phase refrigerant to the inlet port 111 of the compressor 110.

The refrigerant vaporized in the outdoor heat exchanger 120 or the indoor heat-exchanger 130 may be introduced into the accumulator 140 through the converter valve 180. Accordingly, the accumulator 140 may be maintained at a temperature of about 0 degree to about 5 degrees, and cold and heat may be emitted to the outside. A surface temperature of the accumulator 140 may be lower than a temperature of the refrigerant condensed in the outdoor heat-exchanger 120 during the cooling operation. The accumulator 140 may have a cylindrical shape, which may be long in a longitudinal direction.

The accumulator jacket 200 may be disposed to cover the surface of the accumulator 140. The accumulator jacket 200 may thermally contact the surface of the accumulator 140. The accumulator jacket 200 may be formed of a material having a high thermal conductivity for the heat-exchange between the accumulator 140 and the refrigerating fluid. More specifically, the accumulator jacket 200 may be disposed such that an inner circumferential surface of the accumulator jacket 200 contacts the outer circumferential surface of the accumulator 140. The accumulator jacket 200 may be formed so as to correspond to a length of the accumulator 140 for sufficient heat-exchange between the accumulator 140 and the refrigerating fluid.

The accumulator jacket 200 may be connected to the supercooling heat-exchange hub 190, the circulating pump 191, and the accumulator 140. The refrigerating fluid may flow in the accumulator jacket 200 to exchange heat with the accumulator 140. The accumulator jacket 200 may include a flow passage 210 to allow the refrigerating fluid to flow along the surface of the accumulator 140. Accordingly, the refrigerating fluid introduced from the supercooling heat-exchange hub 190 to the accumulator jacket 200 by the driving of the circulating pump 191 may flow on the surface of the accumulator 140 along the flow passage 210, exchanging heat with the accumulator 140. The heat-exchanged refrigerating fluid may flow into the supercooling heat-exchange hub 190.

The flow passage 210 of the accumulator jacket 200 may have an inlet, through which the refrigerating fluid may be introduced to a lower side of the accumulator 140, and an outlet, through which the refrigerating fluid having absorbed cold and heat of the accumulator 140 may be discharged. Accordingly, the refrigerating fluid introduced from the supercooling heat-exchange hub 190 may circulate on the circumferential surface of the accumulator 140 along the flow passage 210 to absorb cold and heat of the accumulator 140, and then, may be discharged to the supercooling heat-exchange hub 190 through the outlet.

The supercooling heat-exchange hub 190 may be disposed between the indoor heat-exchanger 130 and the outdoor heat-exchanger 120. The supercooling heat-exchange hub 190 may be connected to, or in fluid communication via the piping the accumulator jacket 200, the injection module 170, the circulating pump 191, and the outdoor expansion valve 150. As the supercooling heat-exchange hub 190 is connected to, or in fluid communication via the piping the accumulator jacket 200, the refrigerating fluid having absorbed cold and heat emitted from the accumulator 140 may be stored in the supercooling heat-exchange hub 190. As the supercooling heat-exchange hub 190 is connected to, or in fluid communication via the piping the circulating pump 191, the refrigerating fluid stored in the supercooling heat-exchange hub 190 may forcibly flow to the accumulator jacket 200.

The supercooling heat-exchange hub 190 may include a pipe therein. During the cooling operation, the refrigerant condensed in the outdoor heat-exchanger 120 and having passed through the outdoor expansion valve 150 may flow in the pipe. Accordingly, during the cooling operation, heat-exchange between the refrigerant condensed in the outdoor heat-exchanger 120 and the refrigerating fluid may occur in the supercooling heat-exchange hub 190. In this case, a temperature of the refrigerating fluid may be lower than a temperature of the refrigerant condensed in the outdoor heat-exchanger 120. Accordingly, the temperature of the refrigerating fluid may rise, and the temperature of the condensed refrigerant may fall, causing supercooling.

The pipe disposed in the supercooling heat-exchange hub 190 and allowing the refrigerant to flow therein may be disposed in a zigzag pattern. Accordingly, the heat-exchange between the refrigerating fluid and the refrigerant in the supercooling heat-exchange hub 190 may occur for a long period of time. The supercooling heat-exchange hub 190 may be formed to have a large size to store a large amount of the refrigerating fluid.

The circulating pump 191, as shown in FIG. 2, may be installed in the outdoor device, and may be disposed over the supercooling heat-exchange hub 190. The circulating pump 191 may forcibly circulate the refrigerating fluid in the supercooling heat-exchange hub 190 and the accumulator jacket 200. During the cooling operation, the circulating pump 191 may allow the refrigerating fluid heat-exchanged in the accumulator 140 to be stored in the supercooling heat-exchange hub 190 by forcibly circulating the refrigerating fluid. During the heating operation, the circulating pump 191 may not operate to forcibly circulate the refrigerating fluid. Although the circulating pump 191 does not operate during the heating operation, natural circulation may occur due to a convection phenomenon. Due to the natural circulation, the refrigerating fluid may flow to the accumulator jacket 200, and may exchange heat with the accumulator 140.

The circulating pump 191 may be disposed between the supercooling heat-exchange hub 190 and the accumulator jacket 200. The circulating pump 191 may be a typical pump, and a plurality of the circulating pump 191 may be provided to increase a circulation force. A blocking valve (not shown) may be disposed between the accumulator jacket 200 and the supercooling heat-exchange hub 190 to block the flow of the refrigerating fluid. During the heating operation, the blocking valve (not shown) may be closed to prevent the refrigerating fluid from flowing due to the natural circulation. During the cooling operation, the blocking valve (not shown) needs to be opened because the circulating pump 191 operates.

Hereinafter, operation of the air conditioner configured as above will be described as follows.

Figure 4:
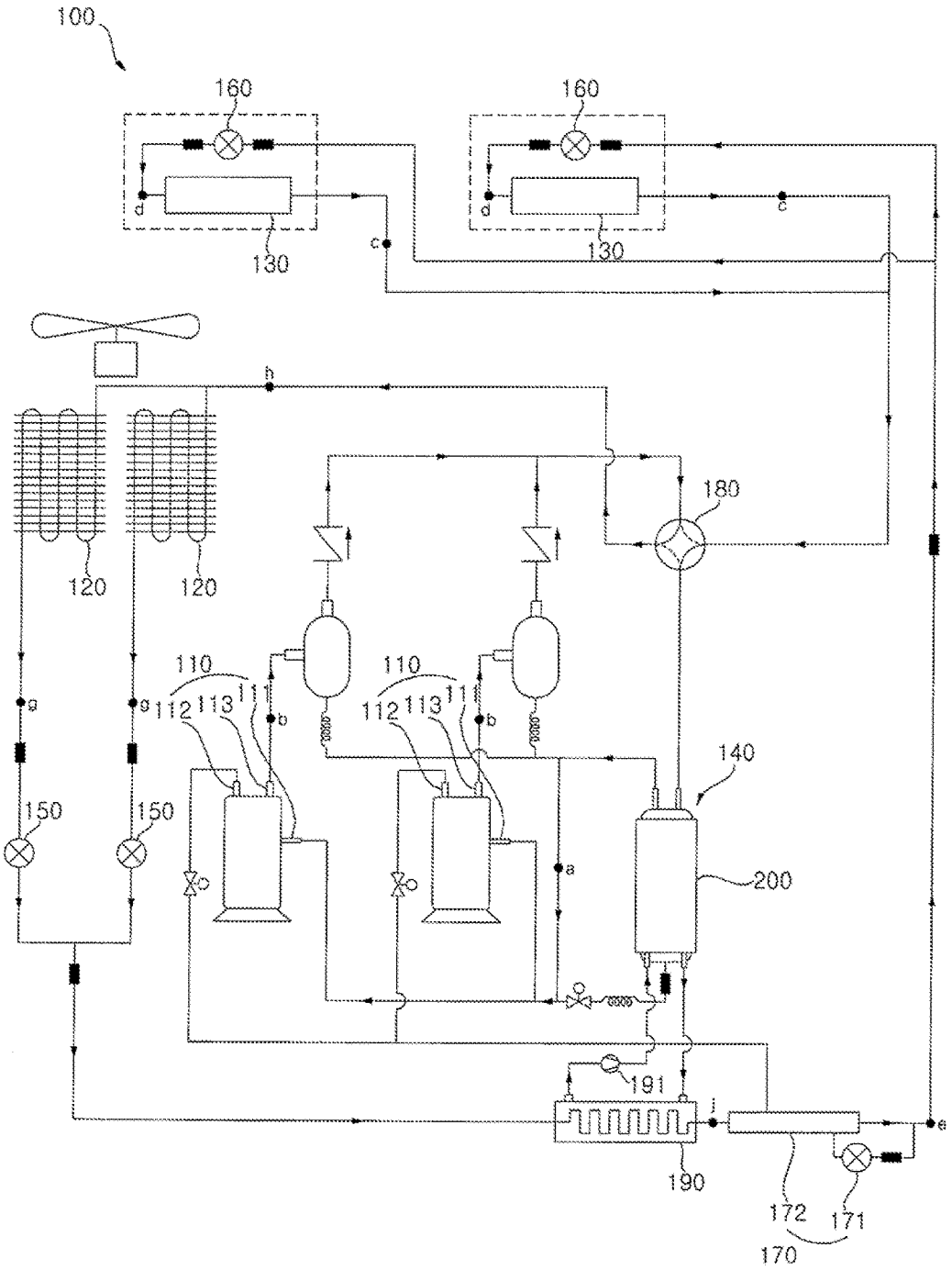
FIG. 4 is a schematic diagram illustrating a flow of refrigerant during a cooling operation of an air conditioner according to an embodiment.
Figure 5:
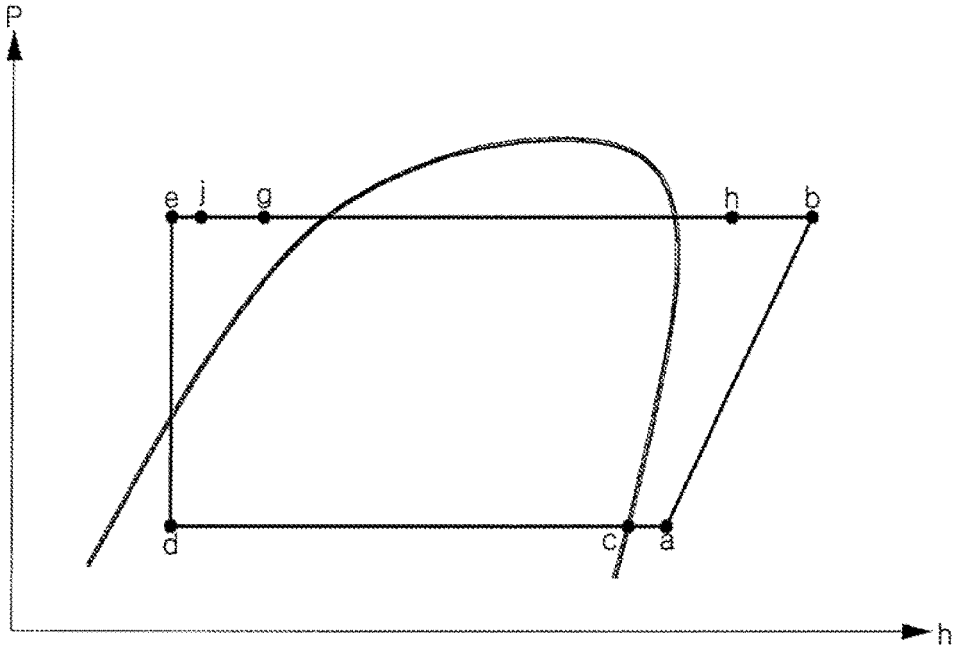
FIG. 5 is a pressure-enthalpy diagram (hereinafter, referred to as P-h diagram) during the cooling operation of the air conditioner of FIG. 4.

FIG. 4 is a schematic diagram illustrating a flow of refrigerant during a cooling operation of an air conditioner according to an embodiment. FIG. 5 is a pressure-enthalpy diagram (hereinafter, referred to as P-h diagram) during the cooling operation of the air conditioner of FIG. 4.

Hereinafter, a cooling operation of air conditioner 100 according to an embodiment will be described with reference to FIGS. 4 and 5.

The refrigerant compressed in the compressor 110 may be discharged through the outlet port 113, and may flow to the converter valve 180. The refrigerant discharged through the outlet port 113 and flowing to the converter valve 180 may pass a point b. In this case, as shown in FIG. 5, the refrigerant may be in a high temperature and high pressure state.

During the cooling operation, as the converter valve 180 connects the outlet port 113 of the compressor 110 to the outdoor heat-exchanger 120, the refrigerant flowing to the converter valve 180 may flow to the outdoor heat-exchanger 120 via a point h. The refrigerant passing through the point h may be maintained in pressure, but may be slightly lowered in temperature compared to the refrigerant at the point b.

The refrigerant flowing from the converter valve 180 to the outdoor heat-exchanger 120 may exchange heat with the outdoor air in the outdoor heat-exchanger 120, and thus, may be condensed. The refrigerant condensed in the outdoor heat-exchanger 120 may flow to the outdoor expansion valve 150 via a point g. The condensed refrigerant at the point g may be maintained in pressure, but may be greatly lowered in temperature compared to the refrigerant at the point h.

The refrigerant condensed in the outdoor heat-exchanger 120 may flow to the outdoor expansion valve 150. During the cooling operation, the outdoor expansion valve 150 may be completely opened, and thus, may allow the refrigerant to pass therethrough, guiding the refrigerant to the supercooling heat-exchange hub 190.

During the cooling operation, the refrigerating fluid stored in the supercooling heat-exchange hub 190 may forcibly flow to the accumulator jacket 200 due to the driving of the circulating pump 191. The temperature of the refrigerating fluid flowing from the supercooling heat-exchange hub 190 to the accumulator jacket 200 may be lowered due to the heat-exchange with the accumulator 140. The low temperature refrigerating fluid heat-exchanged with the accumulator 140 may be stored in the supercooling heat-exchange hub 190 by the circulating pump 191.

The refrigerant flowing from the outdoor expansion valve 150 to the supercooling heat-exchange hub 190 may pass through the pipe disposed inside of the supercooling heat-exchange hub 190. The refrigerant passing through the pipe disposed inside the supercooling heat-exchange hub 190 may exchange heat with the refrigerating fluid. The refrigerant heat-exchanged in the supercooling heat-exchange hub 190 may pass a point j, and may flow to the injection module 170. The refrigerant at the point j may be maintained in pressure, but may be lowered in temperature compared to the refrigerant at the point g.

During the cooling operation, as the injection expansion valve 171 of the injection module 170 is closed, the refrigerant may pass a point e and flow to the indoor expansion valve 160 without being heat exchanged in the injection module 170. The refrigerant at the point e may be little changed in pressure and temperature compared to the refrigerant at the point j.

The refrigerant flowing to the indoor expansion valve 160 may expand and flow to the indoor heat-exchanger 130 via a point d. The refrigerant passing through the point d may be maintained in temperature, but may be greatly lowered in pressure compared to the refrigerant at the point e. In one embodiment, the refrigerant passing through the point d may be slightly lowered in temperature, and may be greatly lowered in pressure compared to the refrigerant at the point e.

The refrigerant flowing to the indoor heat-exchanger 130 may exchange heat with the indoor air in the indoor heat-exchanger 130, and thus, may be vaporized. The refrigerant vaporized in the indoor heat-exchanger 130 may flow to the convertervalve 180 via a point c. The refrigerant passing through the point c may be maintained in pressure, but may be greatly increased in temperature compared to the refrigerant at the point d.

As the converter valve 180 connects the indoor heat-exchanger 130 to the accumulator 140 during the cooling operation, the refrigerant flowing from the indoor heat-exchanger 130 to the converter valve 180 may flow to the accumulator 140. The refrigerant flowing to the accumulator 140 may be separated into a gas-phase refrigerant and a liquid-phase refrigerant, and the gas-phase refrigerant may flow to inlet port 111 of the compressor 110 via a point a. The refrigerant passing through the point a may be maintained in pressure, but may be slightly increased in temperature compared to the refrigerant at the point c. This is because only the relatively high temperature gas-phase refrigerant among the refrigerant flowing into the accumulator 140 flows to the inlet port 111 of the compressor 110.

The refrigerant flowing to the inlet port 111 may be compressed in the compressor 110, and then, may be discharged through the outlet port 113. That is, the refrigerant flowing into the compressor 110 may be compressed, and may become a high temperature and high pressure refrigerant at the point b of FIG. 5.

Figure 6:
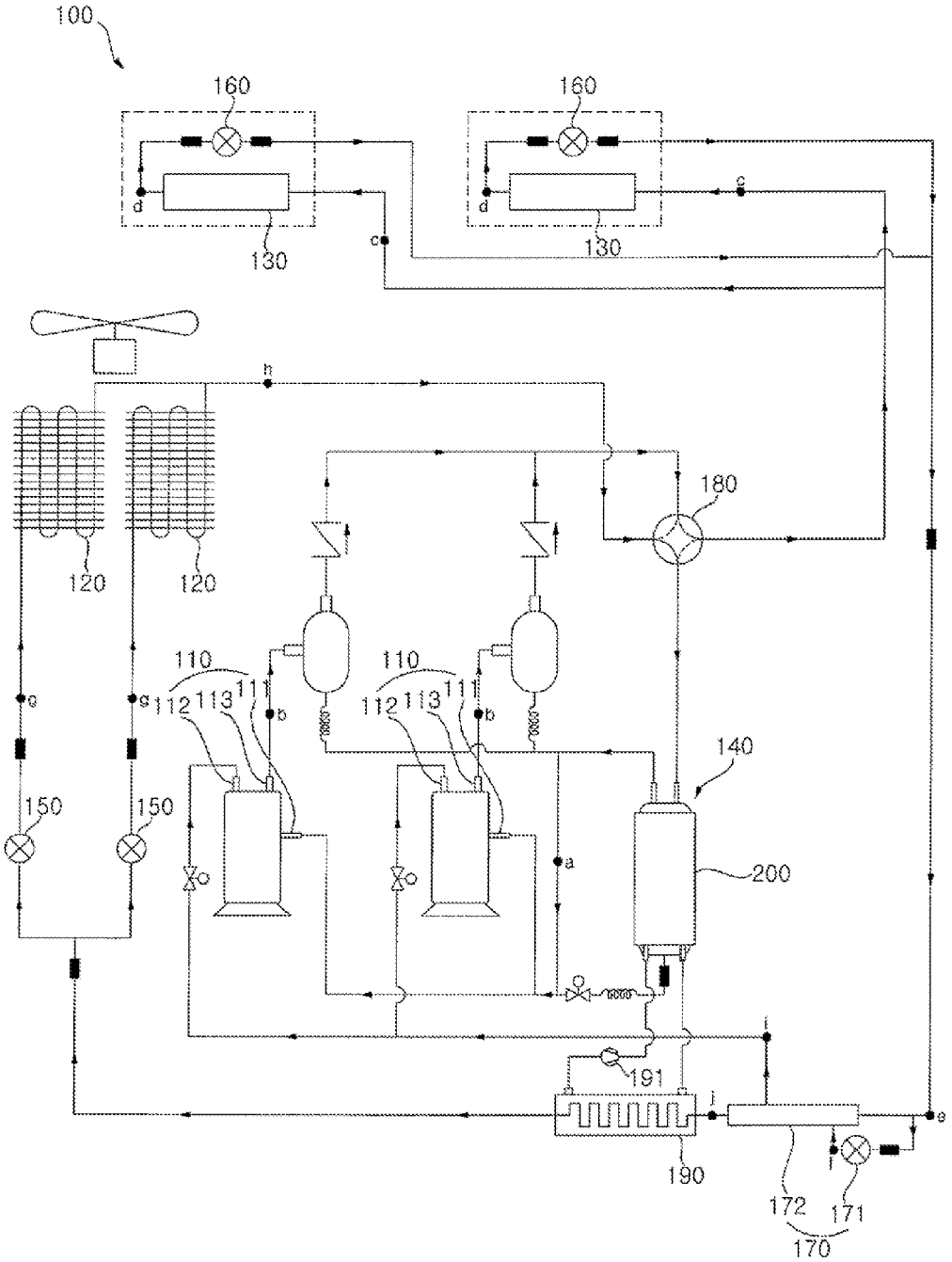
FIG. 6 is a view illustrating a flow of refrigerant during a heating operation of an air conditioner according to an embodiment.
Figure 7:
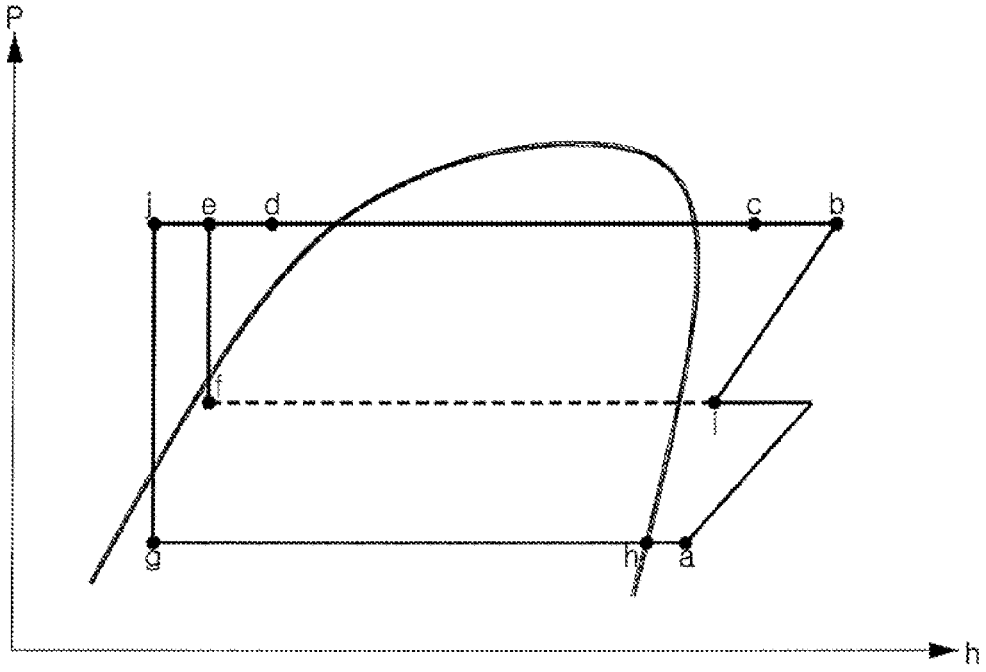
FIG. 7 is a P-h diagram during the heating operation of the air conditioner of FIG. 6.

FIG. 6 is a view illustrating a flow of refrigerant during a heating operation of an air conditioner according to an embodiment. FIG. 7 is a P-h diagram during the heating operation of the air conditioner of FIG. 6.

Hereinafter, a heating operation of air conditioner 100 according to an embodiment will be described with reference to FIGS. 6 and 7.

The refrigerant compressed in the compressor 110 may be discharged through the outlet port 113, and may flow to the converter valve 180. The refrigerant discharged through the outlet port 113 and flowing to the converter valve 180 may pass a point b. In this case, the refrigerant may be in a high temperature and high pressure state, as shown in FIG. 7.

During the heating operation, as the converter valve 180 connects the outlet port 113 of the compressor 110 to the indoor heat-exchanger 130, the refrigerant flowing to the converter valve 180 may flow to the indoor heat-exchanger 130 via a point c. The refrigerant passing through the point c may be maintained in pressure, but may be slightly lowered in temperature compared to the refrigerant at the point b.

The refrigerant flowing from the converter valve 180 to the indoor heat-exchanger 130 may exchange heat with the indoor air in the indoor heat-exchanger 130, and thus, may be condensed. The refrigerant condensed in the indoor heat-exchanger 130 may flow to the indoor expansion valve 160 via a point d. The refrigerant at the point d may be maintained in pressure but may be greatly lowered in temperature due to condensation in the indoor heat-exchanger 130, compared to the refrigerant at the point c.

The refrigerant condensed in the indoor heat-exchanger 130 may flow to the indoor expansion valve 160. During the heating operation, the indoor expansion valve 160 may be completely opened, and thus, may allow the refrigerant to pass therethrough, guiding the refrigerant to the injection module 170 via a point e. The refrigerant passing through the point e may be maintained in pressure, but may be slightly lowered in temperature compared to the refrigerant passing through the point d. A first portion of the refrigerant passing through the indoor expansion valve 160 may flow to the injection expansion valve 171.

During the heating operation, the opening degree of the injection expansion valve 171 may be controlled to expand the refrigerant. Accordingly, the refrigerant flowing to the injection expansion valve 171 may expand and flow to the injection heat-exchanger 172 via a point f. The refrigerant passing through the point f may be maintained in temperature, but may be lowered in pressure compared to the refrigerant at the point e.

The refrigerant expanded in the injection expansion valve 171 may be guided to the injection heat-exchanger 172, and may be vaporized by heat-exchanging with the other or a second portion of the refrigerant flowing to the outdoor heat-exchanger 120 through the indoor expansion valve 160 without passing the injection expansion valve 171. The vaporized refrigerant may flow to the injection port 112 of the compressor 110 via a point i. The refrigerant passing through the point i may be maintained in pressure, but may be increased in temperature compared to the refrigerant at the point f. The refrigerant passing through the point i may be high in pressure and temperature compared to the refrigerant passing through a point a, which is described hereinbelow.

The refrigerant that does not flow to the injection expansion valve 171 among the refrigerant flowing from the indoor expansion valve 160 to the outdoor heat-exchanger 120 may exchange heat with the refrigerant expanded in the injection expansion valve 171 to be overcooled. The overcooled refrigerant may flow to the supercooling heat-exchange hub 190 via a point j. The refrigerant passing through the point j may be maintained in pressure, but may be decreased in temperature compared to the refrigerant at the point e.

During the heating operation, the circulating pump 191 may not operate to forcibly circulate the refrigerating fluid. Accordingly, the refrigerating fluid may not exchange heat with the accumulator 140. Also, the refrigerant passing through the supercooling heat-exchange hub 190 may be little changed in pressure and temperature compared to the refrigerant at the point j. The refrigerant passing through the supercooling heat-exchange hub 190 may flow to the outdoor expansion valve 150.

However, in one embodiment, although the circulating pump 191 does not operate, the refrigerating fluid may also circulate to the accumulator jacket 200 due to natural circulation. The refrigerating fluid may also absorb cold and heat of the accumulator 140 due to the natural circulation, and then, may be stored in the supercooling heat-exchange hub 190. Accordingly, the refrigerant passing through the supercooling heat-exchange hub 190 may be maintained in pressure but may be slightly lowered in temperature compared to the refrigerant at the point j.

The refrigerant flowing to the outdoor expansion valve 150 may expand and flow to the outdoor heat-exchanger 120 via a point g. The refrigerant passing through the point g may be maintained in temperature, but may be greatly lowered in pressure compared to the refrigerant passing through the supercooling heat-exchange hub 190 or the refrigerant at the point j. However, in one embodiment, the refrigerant passing through the point g may also be slightly lowered in temperature and may be greatly lowered in pressure compared to the refrigerant passing through the supercooling heat-exchange hub 190 or the refrigerant at the point j.

The refrigerant expanding in the outdoor expansion valve 150 may flow into the outdoor heat-exchanger 120, and then, may be vaporized by exchanging heat with the outdoor air. The refrigerant vaporized in the outdoor heat-exchanger 120 may flow to the converter valve 180 via a point h. The refrigerant passing through the point h may be maintained in pressure, but may be greatly increased in temperature compared to the refrigerant at the point g.

As the converter valve 180 connects the outdoor heat-exchanger 120 to the accumulator 140 during the heating operation, the refrigerant flowing from the outdoor heat-exchanger 120 to the converter valve 180 may flow to the accumulator 140. The refrigerant flowing to the accumulator 140 may be separated into a gas-phase refrigerant and a liquid-phase refrigerant, and the gas-phase refrigerant may flow to inlet port 111 of the compressor 110 via a point a. The refrigerant passing through the point a may be maintained in pressure, but may be slightly increased in temperature compared to the refrigerant at the point h. This is because only the relatively high temperature gas-phase refrigerant among the refrigerant flowing into the accumulator 140 flows to inlet port 111 of the compressor 110.

The refrigerant flowing to the inlet port 111 may be compressed in the compressor 110, and may be mixed with the refrigerant vaporized in the injection module 170 through the injection port 112 during the compression process. Thus, the temperature and the pressure of the refrigerant compressed may be lowered to a point i. After the refrigerant vaporized in the injection module 170 is mixed, the mixed refrigerant may be again compressed, and may become a high temperature and high pressure refrigerant at the point b to be discharged through the outlet port 113. The refrigerant passing through the point i may be injected into the compressor 110, allowing the temperature of the refrigerant discharged through the outlet port 113 of the compressor 110 to be lowered compared to a case in which the refrigerant is not injected to the compressor 110. Accordingly, overload of the compressor 110 may also be prevented.

Figure 8:
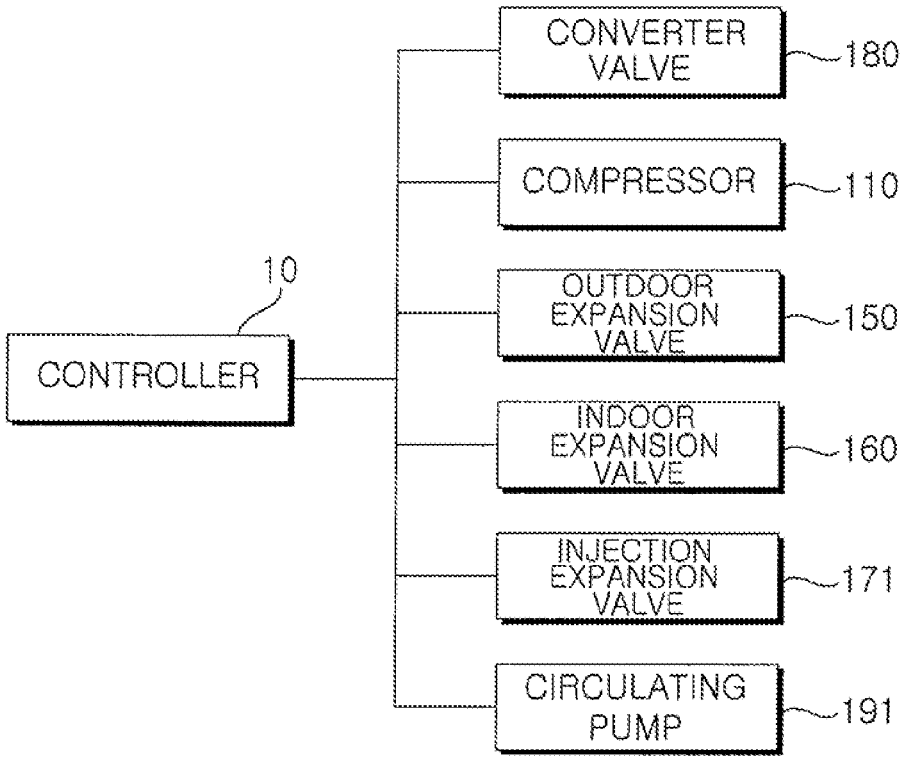
FIG. 8 is a box diagram of components of an air conditioner according to an embodiment.
Figure 9:
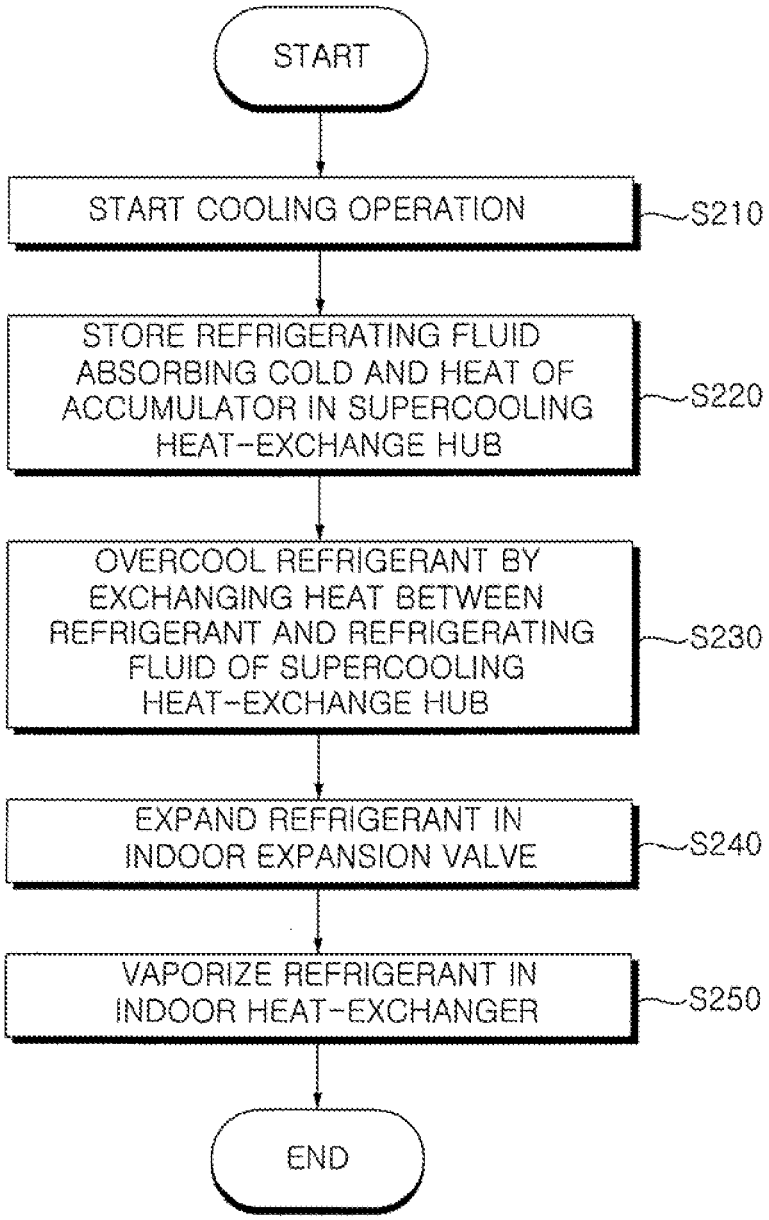
FIG. 9 is a flowchart of a method of controlling an air conditioner during a cooling operation according to an embodiment.

As set forth above, FIG. 4 is a schematic diagram illustrating a flow of refrigerant during the cooling operation of an air conditioner according to an embodiment. FIG. 8 is a box diagram of components of an air conditioner according to an embodiment. FIG. 9 is a flowchart illustrating of a method for controlling an air conditioner during the cooling operation according to an embodiment.

Hereinafter, a cooling operation of air conditioner 100 according to an embodiment will be described with reference to FIGS. 4, 8, and 9.

A control unit or controller 10 may start a cooling operation, in step S210. Upon initiation of the cooling operation, when the controller 10 converts the converter valve 180, the converter valve 180 may connect the outlet port 113 of the compressor 110 to the outdoor heat-exchanger 120, guiding the refrigerant discharged from the compressor 110 to the outdoor heat-exchanger 120.

Upon the initiation of the cooling operation, the controller 10 may drive the circulating pump 191, such that the refrigerating fluid stored in the supercooling heat-exchange hub 190 may be forcibly circulated to the accumulator jacket 200, and the refrigerating fluid forcibly circulated to the accumulator jacket 200 may exchange heat with the accumulator 140 to be cooled, in step S220. The cooled refrigerating fluid may flow to the supercooling heat-exchange hub 190, and then, may be stored therein.

The refrigerant flowing to the outdoor heat-exchanger 120 through the outlet port 113 of the compressor 110 and the converter valve 180 may exchange heat with the outdoor air in the outdoor heat-exchanger 120. Accordingly, the refrigerant passing through the outdoor heat-exchanger 120 may be condensed, in step S220.

Upon the initiation of the cooling operation, the controller 10 may completely open the outdoor expansion valve 150 to guide the refrigerant condensed in the outdoor heat-exchanger 120 to the supercooling heat-exchange hub 190, and may exchange heat between the refrigerant and the refrigerating fluid of the supercooling heat-exchange hub 190 to overcool the refrigerant, in step S230. The overcooled refrigerant may flow to the injection module 170.

The controller 10 may close the injection expansion valve 171 to block the flow of the refrigerant into the injection expansion valve 171. As the injection expansion valve 171 is closed, the overcooled refrigerant flowing to the injection module 170 may flow to the indoor expansion valve 160.

The controller 10 may control the opening degree of the indoor expansion valve 160 to expand the refrigerant flowing to the indoor expansion valve 160, in step S240. The refrigerant expanded in the indoor expansion valve 180 may flow to the indoor heat-exchanger 130. The refrigerant flowing to the indoor heat-exchanger 130 may exchange heat with the indoor air to be vaporized, in step S250. The refrigerant vaporized in the indoor heat-exchanger 130 may flow to the converter valve 180.

Upon the initiation of the cooling operation, the controller 10 may connect the indoor heat-exchanger 130 and the accumulator 140. Accordingly, the refrigerant vaporized in the indoor heat-exchanger 130 may flow to the accumulator 140. The refrigerant flowing into the accumulator 140 may be separated into a gas-phase refrigerant and a liquid-phase refrigerant, and only the gas-phase refrigerant may flow to inlet port 111 of the compressor 110.

The controller 10 may control an operation speed of the compressor 110 according to a control logic of the cooling operation to compress the refrigerant. The high temperature and high pressure refrigerant in the compressor 110 may be discharged to the converter valve 180 through the outlet port 113.

An air conditioner according to an embodiment may have at least one of the following advantages.

First, efficiency may be improved by collecting cold and heat of the accumulator, and thus, supercooling a refrigerant during a cooling operation.

Second, a reduction of a mass and flow rate of the refrigerant directed to the indoor heat-exchanger may be prevented by collecting cold and heat of the accumulator, and thus, supercooling refrigerant during a cooling operation.

Third, embodiments disclosed herein may be employed in all systems including the accumulator regardless of a type of refrigerant.

Advantages are not limited to the above; other advantages that are not described herein will be clearly understood by the persons skilled in the art.

Embodiments disclosed herein provide an air conditioner that may improve efficiency by overcooling a refrigerant using cold and heat of an accumulator during a cooling operation.

Embodiments disclosed herein provide an air conditioner that may include a compressor that compresses a refrigerant; an outdoor heat-exchanger disposed outside of a room to exchange heat with outdoor air; an indoor heat-exchanger disposed inside of the room to exchange heat with indoor air; a converter valve that guides the refrigerant discharged out of the compressor to the outdoor heat-exchanger during a cooling operation and guides the refrigerant to the indoor heat-exchanger during a heating operation; an accumulator disposed between the compressor and the converter valve to separate the refrigerant into a liquid-phase refrigerant and a gas-phase refrigerant; an accumulator jacket disposed on a surface of the accumulator and containing a refrigerating fluid flowing therein, the refrigerating fluid exchanging heat with the accumulator to be cooled; and a supercooling heat-exchange hub connected to the accumulator jacket to store the cooled refrigerating fluid and overcooling the refrigerant flowing between the outdoor heat-exchanger and the indoor heat-exchanger. The accumulator jacket may include a flow passage that allows the refrigerating fluid to flow along the surface of the accumulator.

The air conditioner may further include a circulating pump that forcibly circulates the refrigerating fluid flowing in the supercooling heat-exchange hub and the accumulator jacket. The circulating pump may operate during the cooling operation, and not operate during the heating operation The overcooling heat-exchange hub may overcool the refrigerant flowing from the outdoor heat-exchanger to the indoor heat-exchanger during the cooling operation.

The air conditioner may further include an injection module disposed between the outdoor heat-exchanger and the indoor heat-exchanger, that injects a portion of the refrigerant flowing between the outdoor heat-exchanger and the indoor heat-exchanger to the compressor. The injection module may include an injection expansion valve that expands a first portion of the refrigerant flowing between the indoor heat-exchanger and the outdoor heat-exchanger, and an injection heat-exchanger that exchanges heat between the other or a second portion of the refrigerant flowing between the indoor heat-exchanger and the outdoor heat-exchanger and the refrigerant expanding in the injection expansion valve. The injection valve may be opened during the heating operation, and closed during the cooling operation.

Although the embodiments have been disclosed for illustrative purposes, those skilled in the art will appreciate that various modifications, additions and substitutions are possible, without departing from the scope as disclosed in the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor that compresses a refrigerant;

an outdoor heat-exchanger that performs heat exchange of the refrigerant with outdoor air;

an indoor heat-exchanger that performs heat exchange of the refrigerant with indoor air;

a converter valve that guides the refrigerant discharged from the compressor to the outdoor heat-exchanger in a cooling operation and guides the refrigerant to the indoor heat-exchanger in a heating operation;

an accumulator disposed between the compressor and the converter valve to separate the refrigerant into a liquid-phase refrigerant and a gas-phase refrigerant;

an accumulator jacket disposed on a surface of the accumulator and configured to contain a refrigerating fluid flowing therein to heat exchange with the accumulator to thereby be cooled;

a supercooling heat-exchange hub configured to store the refrigerating fluid cooled at the accumulator jacket and to overcool the refrigerant flowing between the outdoor heat-exchanger and the indoor heat-exchanger;

an injection module, disposed between the outdoor heat-exchanger and the indoor heat-exchanger, that injects a portion of the refrigerant flowing between the outdoor heat-exchanger and the indoor heat-exchanger to the compressor; and a circulating pump configured to forcibly circulate the refrigerating fluid flowing in the supercooling heat-exchange hub and the accumulator jacket, wherein the injection module comprises;

an injection expansion valve that expands a first portion of the refrigerant flowing between the indoor heat-exchanger and the outdoor heat-exchanger; and an injection heat-exchanger that performs heat exchange between a second portion of the refrigerant flowing between the indoor heat-exchanger and the outdoor heat-exchanger and the refrigerant expanded in the injection expansion valve, wherein the circulating pump is configured to operate in the cooling operation, and not to operate in the heating operation, and wherein the injection valve is configured to be open in the heating operation, and to be closed in the cooling operation.

2. The air conditioner of claim 1, wherein the accumulator jacket comprises a flow passage configured to allow the refrigerating fluid to flow along the surface of the accumulator.

3. The air conditioner of claim 2, wherein an inner circumferential surface of the accumulator jacket contacts an outer circumferential surface of the accumulator.

4. The air conditioner of claim 3, wherein a length of the accumulator jacket the same as a length of the accumulator.

5. The air conditioner of claim 1, wherein the supercooling heat-exchange hub is configured to overcool the refrigerant flowing from the outdoor heat-exchanger to the indoor heat-exchanger in the cooling operation.

6. The air conditioner of claim 1, wherein the supercooling heat exchange hub comprises a pipe having a zigzag pattern.

7. The air conditioner of claim 1, wherein the converter valve comprise a four-way valve.

* * * * *